US005655580A

United States Patent [19]

Schrock

[11] Patent Number: 5,655,580

[45] Date of Patent: Aug. 12, 1997

[54] FLUID TRANSFER DEVICE

[76] Inventor: Michael L. Schrock, 500 S. Jefferson St., Greenup, Ill. 62428

[21] Appl. No.: 660,128

[22] Filed: Jun. 7, 1996

[51] Int. Cl.[6] ..... B65B 39/00

[52] U.S. Cl. ..... 141/332; 141/338; 141/340; 141/364

[58] Field of Search ..... 141/331, 332, 141/340–343, 338, 364, 375; D15/150; D7/700; D23/200

[56] References Cited

U.S. PATENT DOCUMENTS

| | | | |
|---|---|---|---|
| 260,079 | 6/1882 | Barnes | 141/340 |
| 292,629 | 1/1884 | Doty | 141/340 |
| 545,915 | 9/1895 | Russell | 141/341 |
| 578,671 | 3/1897 | Wisdom | 141/332 |
| 719,128 | 1/1903 | McGuire | 141/341 |
| 1,484,357 | 2/1924 | Mullen | 141/340 |
| 3,261,380 | 7/1966 | Holleman | 141/106 |
| 4,140,160 | 2/1979 | Glackin | 141/332 |
| 4,207,933 | 6/1980 | Howson | 141/106 |
| 4,217,941 | 8/1980 | Catalano | 141/364 |
| 5,385,180 | 1/1995 | Wittman | 141/340 |

*Primary Examiner*—J. Casimer Jacyna
*Attorney, Agent, or Firm*—Philip L. Bateman

[57] ABSTRACT

A device is used to drain a viscous fluid from a substantially empty pouring container into a substantially full receiving container. The device contains a vertically-oriented funnel having an open wide top and an open narrow bottom, a top damping means connected to the funnel and adapted to clamp and hold a pouring container in an inverted position over and in vertical alignment with the funnel, and a bottom clamping means connected to the funnel and adapted to clamp and hold a receiving container in an upright position under and in vertical alignment with the funnel. When the top clamping means is clamped onto a substantially empty pouring container and the bottom clamping means is clamped onto a substantially full receiving container, a stable assembly is formed which can be left unattended for hours.

4 Claims, 1 Drawing Sheet

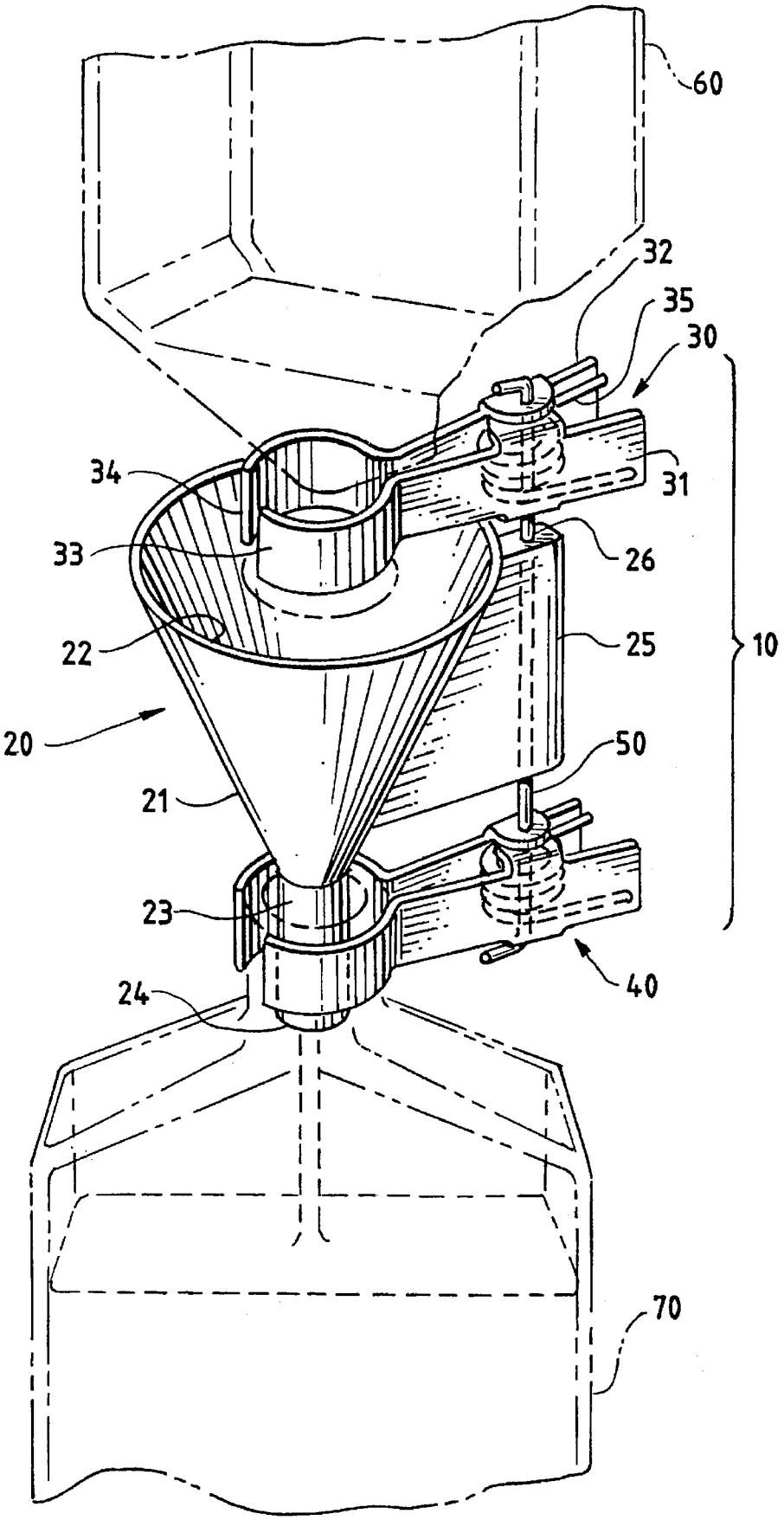
60
32
35
30
34
31
33
26
22
25
10
20
50
21
23
40
24
70

FLUID TRANSFER DEVICE

FIELD OF THE INVENTION

This invention relates to the handling of fluids. More particularly, this invention relates to devices for transferring fluids from one container to another.

BACKGROUND OF THE INVENTION

Many cosmetics are sold for personal use in the form of a viscous fluid and are packaged in containers having a threaded neck and cap. Examples of such cosmetics include soaps, shampoos, cream rinses, hand lotions, and the like. These fluids are often so viscous that it takes a very long time to completely empty the fluid from the container. As a result, the containers are often discarded with a significant amount of fluid still within them.

Some persons try to recover the last remaining amount of fluid in a container by removing the cap, inverting the nearly-empty container, and holding it over a new container having its cap removed. This type of transfer is too time-consuming to hold the pouring container by hand so it is typically balanced on the receiving container in some way. The major problem with this transfer process is that the pouring container is in a very unstable position—inverted and resting on its neck upon the neck of the receiving container. Accordingly, the slightest bump or jar will tip the assembly and result in spills and/or breakage of one or both of the containers (if they are made of a breakable material). It would be very desirable to provide a hands-free, compact, and stable fluid transfer device that would enable a viscous fluid to be completely drained from a pouring container to a receiving container.

A number of fluid transfer devices have been disclosed. Doty, U.S. Pat. No. 292,629, issued Jan. 29, 1884, discloses a device for filling fruit jars. The device includes a hand-held clamp that secures the jar being filled. A funnel is connected to the clamp and suspended above the jar. This device is not hands-free because the clamp must be held in the hand. Furthermore, there is no means for holding a pouring container above the funnel.

Russell, U.S. Pat. No. 545,915, issued Sep. 10, 1895, discloses a fluid transfer device having a base, a vertical rod arising from the base, and a funnel that is connected to the rod in such a way that the funnel can move freely up and down the rod in a vertical orientation. A pouring container has a ring at its base that fits over the rod to secure it in position. The Russell device is hands-free, but it is used only with pouring containers having a ring that fits over the rod. Furthermore, the Russell device is large—the height of the rod is at least equal to the combined heights of the receiving container, the funnel, and the pouring container.

Holleman, U.S. Pat. No. 3,261,380, issued Jul. 19, 1966, discloses a fluid transfer device for draining substantially empty ketchup bottles into fresh ketchup bottles. The device includes a base, a vertical post arising from the middle of the base, two clamps to hold the inverted bottles, and four rings to hold the fresh bottles. The device is large, not adaptable for bottles of different sizes, has no funnel to reduce or eliminate spills, and relies upon its heavy base for stability.

Howson, U.S. Pat. No. 4,207,933, issued Jun. 17, 1980, discloses a fluid transfer device having three platforms—a base, a shelf for holding a funnel, and a retaining rack for holding one or more pouring bottles. The three platforms are connected by a vertical, rear wall. The device is large and not adapted for varying sizes of bottles.

Wittman, U.S. Pat. No. 5,385,180, issued Jan. 31, 1995, discloses a funnel adapted for a hands-free transfer of fluid from a pouring container to a receiving container. The funnel has stepped fins extending outwardly and stepped blades extending inwardly. The fins help secure the funnel on the receiving container while the blades help secure the pouring container in place. However, the containers are not secured sufficiently to prevent the assembly from tipping if subjected to a mild bump. Accordingly, a demand still exists for a compact fluid transfer device that facilitates a stable, hands-free transfer from pouring containers to receiving containers of varying sizes.

SUMMARY OF THE INVENTION

The general object of this invention is to provide an improved fluid transfer device. A more particular object is to provide a fluid transfer device especially suited for draining a viscous fluid from a substantially empty pouring container into a substantially full receiving container. Another more particular object is to provide such a device that is stable, yet compact, and adapted for use with many different sizes of containers.

I have invented an improved device for draining a viscous fluid from a substantially empty pouring container into a substantially full receiving container. The device comprises: (a) a vertically-oriented funnel having an open wide top and an open narrow bottom; (b) a top clamping means connected to the funnel and adapted to clamp and hold a pouring container in an inverted position over and in vertical alignment with the funnel; and (c) a bottom clamping means connected to the funnel and adapted to clamp and hold a receiving container in an upright position under and in vertical alignment with the funnel; such that, when the top clamping means is clamped onto a substantially empty, inverted, pouring container and the bottom clamping means is clamped onto a substantially full, upright, receiving container, a stable assembly is formed.

The fluid transfer device of this invention is compact and yet, when clamped to a substantially empty pouring container and a substantially full receiving container, forms a very stable assembly. The device is adapted for use with many different sizes of containers.

BRIEF DESCRIPTION OF THE DRAWING

The drawing is a perspective view of the preferred embodiment of the fluid transfer device of this invention.

DETAILED DESCRIPTION OF THE INVENTION

This invention is best understood by reference to the drawing. The drawing show the preferred embodiment of the fluid transfer device 10 of this invention. The device contains four components—a funnel 20, a top clamp 30, a bottom clamp 40, and a connecting rod 50. Each component is discussed in detail below. A pouring container 60 and a receiving container 70 are shown in phantom lines.

The funnel 20 is of the conventional type consisting of a conical portion 21 with a wide open top 22 tapering to a narrow spout 23 with an open bottom 24. The conical portion of the funnel is generally tapered at an angle of about 30° to 80° to the horizontal and preferably about 45° to 75°. The spout portion is generally tapered at an angle of about 75° to 90°. The size of the funnel is a matter of choice depending on the size of the container whose fluid is to be transferred and on the quantity of fluid remaining in the container. In the case of a typical household cosmetic container having a volume of about 500 ml, a funnel having a maximum diameter of about 5 cm, a height of about 5 cm, and a volume of about 30 ml is adequate. Larger funnels having a volume of 100 ml to 1 liter or more are used in industrial applications where the pouring containers frequently exceed 5 liters in volume.

The funnel is preferably made of a rigid material that resists breakage. Suitable materials include rust-proof metals, such as aluminum and stainless steel, and plastics, such as polyethylene, polypropylene, polymethacrylate, and the like. Plastics are preferred for household use because of their low weight and low cost. The interior of the funnel is preferably smooth to facilitate the flow of fluid. The outside of the funnel may be smooth, fibbed for strength, and/or may contain other projections. The funnel shown in the drawing contains a fin 25 with a vertical channel 26 that is used to connect the funnel to the other components of the device, as explained in detail below.

The top clamp 30 is connected to the funnel. It has opposing, pivoting arms 31 and 32 with jaws 33 and 34 that are forced together by the action of spring 35. The clamp is positioned so that its jaws are over the open end of the funnel. The clamp is preferably positioned a short distance, generally less than about 5 cm, above the top of the funnel to minimize the size of the fluid transfer device. In the preferred embodiment shown in the drawing, the distance between the top clamp and the funnel is about 5 mm. The jaws are adapted for holding cylindrical objects like the neck of a pouring container. They are preferably curved or angled to provide additional area of contact. However, excessive curving or angling is undesirable because it limits the range of diameters that can be securely held by the jaws. If desired, the gripping ability of the jaws is further enhanced by providing a non-smooth surface on the face of the jaws. For example, teeth or serrations, such as those present on the face of the jaws of pliers, are beneficial. The arms and jaws are typically made of a plastic identical or similar to that of the funnel. The spring is typically made of metal.

The spring-loaded clamp shown in the drawing is preferred because it is easiest to clamp and unclamp. The spring shown in the drawing is of the torsional type that forces the jaws together by forcing the opposite ends of the arms apart. However, many other spring configurations are also suitable. For example, conventional clothespins and the clamp shown in Welch, U.S. Pat. No. 4,356,600, issued Nov. 2, 1982, use torsional springs that directly force the jaws together. Other suitable spring configurations include compression coils, bent bands, and the torsional spring configuration shown in Groth, U.S. Pat. No. 4,394,791, issued Jul. 26, 1983. Clamping means not including a spring are also suitable. Many different types of clamping means without springs are known in the art and include screws, sliding circular rings, clips, and the like.

The bottom clamp 40 is also connected to the funnel. It is positioned in an overlapping relationship with the spout of the funnel or a short distance below the funnel. For purposes of compactness, the overlapping position is preferred. As seen in the drawing, an overlapping bottom clamp also enables the spout to enter the mouth of the receiving container, thereby reducing the possibility of spills or drips. In other respects, the bottom clamp is identical or similar to the top clamp.

As previously mentioned, the top and bottom clamps are connected to the funnel. A preferred means of connection is shown in the drawing. A vertical connecting rod 50 passes through the channel in the fin of the funnel. The rod also passes through openings in the springs of the clamps. The ends of the rod are bent at right angles to hold the rod in place. In this embodiment, the top clamp can be swiveled 360° to any desired position. When the top clamp is swiveled away from the funnel opening, the fluid transfer device can be used as a conventional funnel for the rapid transfer of non-viscous fluids such as mouthwashes, alcohol-based skin cleansers, etc. A large number of other connecting means are also suitable and the components of the fluid transfer device can be molded in various combinations. For example, the rod can be molded as part of the funnel and fin assembly.

The use of the fluid transfer device of this invention can now be considered. To transfer the fluid from a substantially empty pouring container 60 to a substantially full receiving container 70, the caps of both containers are first removed. The bottom clamp of the fluid transfer device is then secured onto the neck of the receiving container with the spout of the funnel extending downwardly into the neck. The pouring container is then inverted over the top of the funnel and clamped in place with the top clamp. The weight of the receiving container provides stability to the assembly and it can be left for hours, if necessary, to allow all the fluid from the pouring container to drain into the receiving container. When the fluid transfer is completed, the pouring container is discarded and the cap of the receiving container is replaced. The term "fluid" is used herein to include any material that flows and includes both liquids and solids. The fluid transfer device of this invention is easy to use, durable, easily washable, and is so compact that it requires very little storage space in a drawer or cabinet.

I claim:

1. A device for draining a viscous fluid from a substantially empty pouring container into a substantially full receiving container, the device comprising:

(a) a vertically-oriented funnel having an open wide top and an open narrow bottom;

(b) a top clamp connected to the funnel and adapted to clamp and hold a pouring container in an inverted position over and in vertical alignment with the funnel, the top clamp comprising a spring and a pair of opposing and pivoting arms with jaws at one end, which jaws are forced together by the spring; and (c) a bottom clamp connected to the funnel and adapted to clamp and hold a receiving container in an upright position under and in vertical alignment with the funnel, the bottom clamp comprising a spring and a pair of opposing and pivoting arms with jaws at one end, which jaws are forced together by the spring; such that, when the top clamp is clamped onto a substantially empty, inverted, pouring container and the bottom clamp is clamped onto a substantially full, upright, receiving container, a stable assembly is formed.

2. The device of claim 1 additionally comprising a vertical rod that connects the funnel, top clamp, and bottom clamp together.

3. The device of claim 2 wherein the top clamp is positioned less than about 5 cm above the funnel.

4. The device of claim 2 wherein the bottom clamp is positioned in an overlapping relationship with the funnel.

* * * * *